US005740629A

United States Patent [19]

Fischer et al.

[11] Patent Number: 5,740,629

[45] Date of Patent: Apr. 21, 1998

[54] FORTIFIED GATE SYSTEM AND LOCKING DEVICE

[75] Inventors: Kenn C. Fischer, Burnt Hills; Kevin E. Higgins, S. Glens Falls, both of N.Y.; Ronald J. Massa, Bedford, Mass.

[73] Assignee: The Tymetal Corporation, Clifton Park, N.Y.

[21] Appl. No.: 686,119

[22] Filed: Jul. 23, 1996

[51] Int. Cl.[6] ..... E01F 13/02

[52] U.S. Cl. ..... 49/9; 256/73; 256/13.1; 49/394; 404/6

[58] Field of Search ..... 49/9, 394; 292/207, 292/333; 256/73, 13.1, 1; 404/6, 9

[56] References Cited

U.S. PATENT DOCUMENTS

| | | | |
|---|---|---|---|
| 321,184 | 6/1885 | Brady . | |
| 326,922 | 9/1885 | Scherer . | |
| 353,481 | 11/1886 | Copeland . | |
| 507,717 | 10/1893 | Neutasche . | |
| 564,388 | 7/1896 | Merritt . | |
| 1,126,728 | 2/1915 | Dillaboug . | |
| 1,231,763 | 7/1917 | Loprete | 49/9 |
| 1,844,767 | 2/1932 | Kelly . | |
| 2,023,538 | 10/1935 | Orr et al. . | |
| 2,189,974 | 2/1940 | Buford . | |
| 2,373,783 | 4/1945 | Schlifer | 292/207 |
| 2,602,249 | 7/1952 | Sawyer . | |
| 2,746,745 | 6/1956 | Damon . | |
| 3,394,497 | 7/1968 | Case . | |
| 3,531,895 | 10/1970 | Appell . | |
| 3,708,192 | 1/1973 | Klebba et al. . | |
| 3,775,906 | 12/1973 | Dougherty . | |
| 3,871,134 | 3/1975 | Lening . | |
| 4,065,878 | 1/1978 | Tsugane . | |
| 4,313,281 | 2/1982 | Richmond . | |
| 4,791,757 | 12/1988 | Orlando . | |
| 4,818,137 | 4/1989 | Gorlov | 49/9 |
| 4,844,653 | 7/1989 | Dickinson | 49/9 |
| 4,916,859 | 4/1990 | Butler | 49/9 |
| 4,938,508 | 7/1990 | Thomas | 292/207 |
| 5,009,542 | 4/1991 | Hardin, Jr. et al. | 404/9 |
| 5,033,905 | 7/1991 | Schmidt et al. | 256/13.1 |
| 5,425,594 | 6/1995 | Krage et al. | 404/6 |
| 5,452,544 | 9/1995 | Weathington | 49/394 |
| 5,499,517 | 3/1996 | McCraw . | |

FOREIGN PATENT DOCUMENTS

| | | | |
|---|---|---|---|
| 0452893 | 10/1991 | European Pat. Off. | 404/6 |

*Primary Examiner*—Anthony Knight
*Assistant Examiner*—Curtis Cohen
*Attorney, Agent, or Firm*—Schmeiser, Olsen & Watts

[57] ABSTRACT

A fortified gate system and locking mechanism is disclosed which utilizes spring loaded locking mechanisms, triggered by the impact of an object such as a vehicle, to interlock a gate, a brace, and fortified anchoring devices. This interconnected structure forms an energy absorbing, impenetrable barrier. Because the gate system functions as a normal gate until an instance of attempted crashing entry, it provides reasonable accessibility while maintaining a high level of security.

18 Claims, 4 Drawing Sheets

FORTIFIED GATE SYSTEM AND LOCKING DEVICE

FIELD OF THE INVENTION

The present invention relates generally to gates. More particularly, the present invention relates to fortified security gates intended to withstand vehicular impacts.

BACKGROUND OF THE INVENTION

Gates used in secured areas such as prisons, airports, power plants, government facilities, research facilities, etc., must provide accessibility without diminishing security. Because of this need for accessibility, gates are often difficult to fortify or reinforce and may constitute a vulnerable spot in a perimeter security system where high powered or high speed vehicles may gain entry by impacting and knocking down the gates.

Several gates have been developed to waylay or stop vehicles attempting encroachment, thus preventing unauthorized entry into secured areas or onto barricaded portions of highway or railroad tracks. Among these are Strauss (U.S. Pat. No. 1,692,425), Orr (U.S. Pat. No. 2,023,538), Sawyer (U.S. Pat. No. 2,602,249) and Buford (U.S. Pat. No. 2,189,974).

U.S. Pat. No. 1,692,425 to Strauss discloses a device for stopping high powered vehicles. This invention includes a liftable barrier that spans a roadway. The barrier raises vertically and remains suspended above the roadway when not in use. Furthermore, the barrier pays out when struck by a vehicle, and has a device for preventing the barrier from being lifted when the vehicle is in contact with it.

While this device is intended to stop high powered vehicles, it provides no fortification other than the gate frame itself. Furthermore, since the barrier disclosed by Strauss includes a meshed cable gate. Thus, if the invention disclosed by Strauss is combined with any standard gate, the effectiveness of the system may be compromised.

U.S. Pat. No. 2,023,538 to Orr et al. discloses a mechanically operated railway crossing barrier. This invention utilizes a resilient shock absorbing bumper at each end of the gate which extends partially across the gate. However, this bumper does not span the gate, nor will it function to prevent gate failure in case of a high powered vehicular impact. Rather, it serves to protect the gate from damage in case it is accidentally bumped by a vehicle. Also, the Orr gate is not fortified against, nor intended to withstand high speed vehicular impacts. Rather, it functions to warn vehicles and block railroad crossings.

U.S. Pat. No. 2,602,249 to Sawyer discloses a yieldable barrier. This barrier provides protection for traffic at movable bridge heads, grade crossings, ferries and the like. This invention concerns an improvement and simplification of the interlocking of the movable mechanism with the structural framing which encloses and supports this mechanism. This movable mechanism carries the snubbing devices for the flexible yielding network which encloses and supports this mechanism.

This device is very similar to that disclosed by Strauss (see above), and possesses several of the same disadvantages with respect to use as a security gate system. First, it may not accommodate standard gates without compromising the strength of the system. Moreover, other than the fortification inherent in the gate and frame, it includes no additional fortification.

U.S. Pat. No. 2,189,974 to Buford discloses a highway gate having a yieldable cable arrangement so that in the event of an impact against the gate, the gate will be allowed to move a predetermined distance so as to aid in resisting the impact. This reference also discloses a gate wherein weights must be lifted when the gate is moved laterally from its normal position so that raising these weights will oppose the lateral movement of the gate and assist in bringing the impacting vehicle to rest.

As with Strauss and Sawyer (see above), the Buford gate uses a cable arrangement which pays out when impacted. Again, however, use of standard gates with this system would compromise or negate its effectiveness. Also, it discloses no additional fortification other than the gate and gate frame.

Thus, these references disclose gates or barriers intended to withstand vehicular impacts at varying speeds. These references fail to provide gates or barriers which may be combined with standard gate systems, and which possess additional fortification aside from the gate and gate frame itself. The aforementioned references are hereby incorporated by reference.

SUMMARY OF THE INVENTION

The present invention provides a fortified gate which, if impacted (e.g. by a vehicle), automatically interconnects with anchors (e.g. precast concrete pillars) or other similar fortifying devices to provide an impenetrable barricade. The present invention may be combined with virtually any type of gate system such as vertical lift gates or horizontally sliding gates. Furthermore, it may be utilized alone or in combination with other deterrent gate systems (e.g. box frame gates or sallyport situations).

This system functions to thwart threats to secured areas by heavy objects such as vehicles or the like. When a gate is impacted (e.g. by a vehicle), the gate absorbs the energy and transfers it to fortified anchors while simultaneously interlocking with those anchors by way of a locking device (e.g. a spring loaded locking pin). With the gate and anchors thus interlocked, the entire system functions as an energy absorbing, unitized system capable of limiting the encroaching object (e.g. vehicle) to a predetermined, acceptable distance.

Because the gate and anchors do not become interconnected until an instance of, for example, vehicular impact, the gate remains reasonably accessible to authorized entry (e.g. vehicles, pedestrians). In its closed position however, the gate remains ready for transition from a passive structure to an active structure by sudden interconnection with the anchors.

It is therefore an advantage of the present invention to provide a fortified gate system which automatically interconnects a gate with anchoring devices when the gate is impacted by an object such as a vehicle.

It is therefore a further advantage of the present invention to provide a fortified gate system which absorbs energy from impact (e.g. vehicular impact).

It is therefore a further advantage of the present invention to limit penetration of an encroaching object (e.g. vehicle) vehicle to a pre-determined distance.

It is therefore a further advantage of the present invention to provide a gate which is secure against attempted crashes to gain entry, but is still reasonably accessible.

It is therefore a further advantage of the present invention to provide a fortified gate system which may be constructed in accordance with a desired level of security to compensate for a projected level of inertial impact.

It is therefore a further advantage of the present invention to provide a gate system which may be retrofitted to existing gates.

BRIEF DESCRIPTION OF THE DRAWINGS

These and other advantages of the present invention will become more apparent upon examination of the drawings wherein like numerals refer to like elements throughout.

DETAILED DESCRIPTION OF THE PREFERRED EMBODIMENTS

Figure 1:
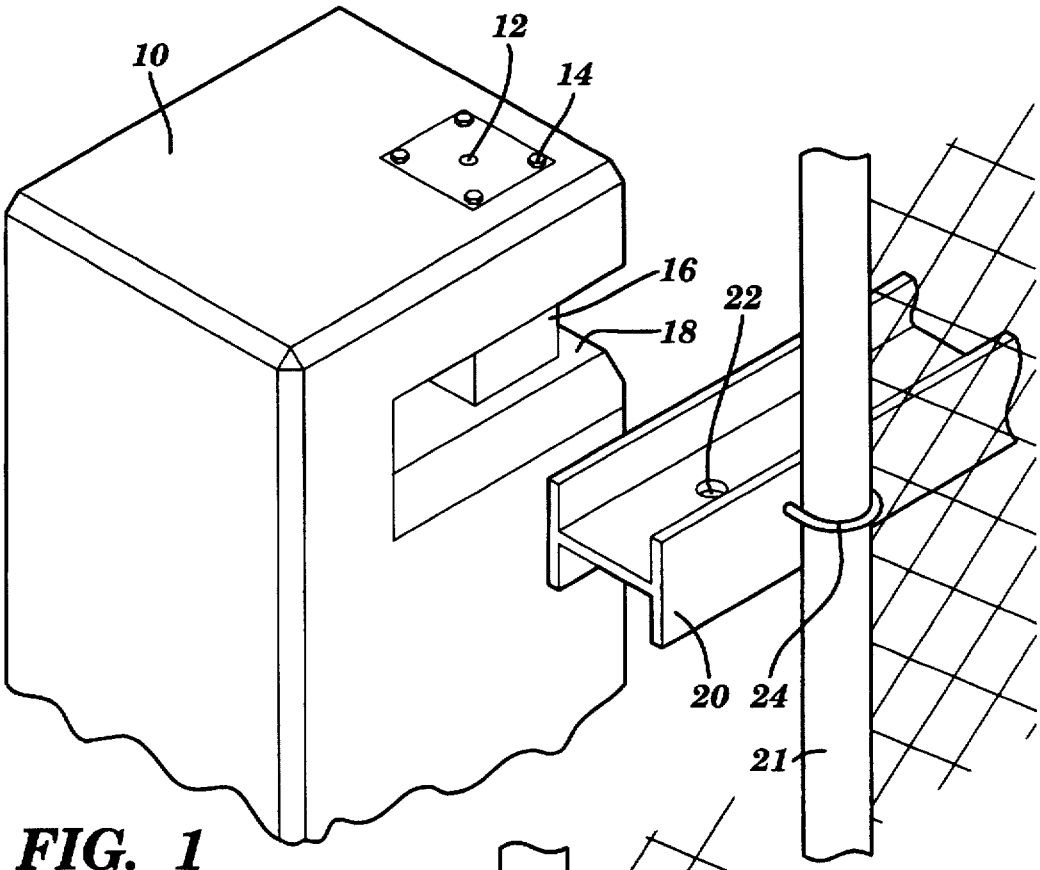
FIG. 1 is a top perspective view of a preferred embodiment of the present invention showing the pre-impact relation of the brace to an anchor.
Figure 4:
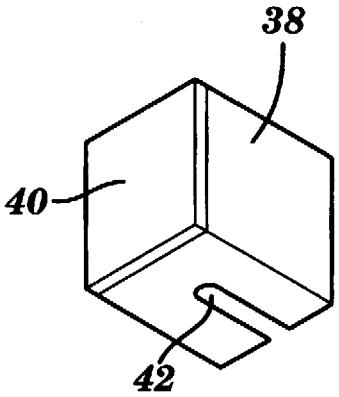
FIG. 4 is a bottom perspective view of a detent device of the present invention.

Referring to FIGS. 1 and 4, a precast concrete anchor 10 is shown in accordance with the first preferred embodiment of the invention. A brace 20 attached to a gate 21 by a steel ring 24 is shown in its pre-impact relation to the anchor 10, the receiving pocket 18 and the detent device 16. Although the brace 20 in this embodiment is a structural steel beam, numerous other structures could be used to brace a gate in this fashion.

A metallic plate 14 attached to the top of the precast concrete anchor 10 serves to stop the spring loaded locking pin 44 in the proper interconnecting position after it has been released. Furthermore, the metallic plate 14 provides a hole 12 for reloading the spring loaded locking pin 44 when desired.

Figure 2:
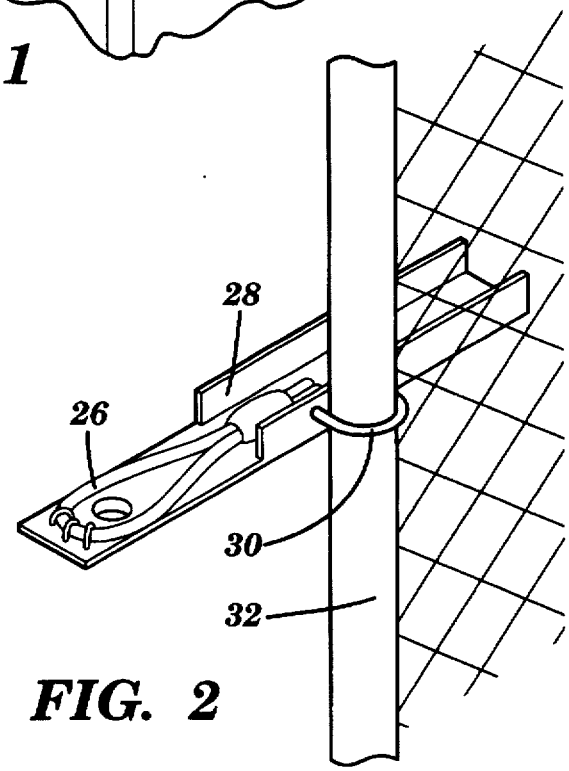
FIG. 2 is a top perspective view of a second preferred embodiment of the present invention showing the brace attached to the gate.

Referring to FIG. 2, a second preferred embodiment of a brace is shown including a longitudinal channel 28 housing a cable 26. As with the first preferred embodiment of the brace, this one is attached to the gate 32 with a steel ring 30 or other attachment device. This embodiment is particularly desirable for wider gates as cable is lighter weight and may be more readily accessible than structural steel beams.

Figure 3:
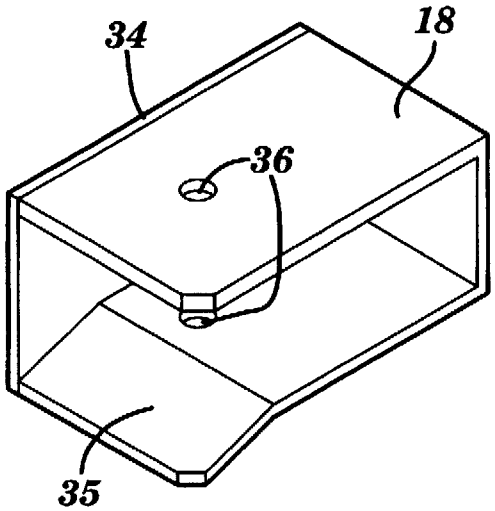
FIG. 3 is a top perspective view of a receiving device of the present invention.

FIG. 3 depicts a receiving pocket 18 for one end of the gate. This pocket may be fashioned from plate steel or other similar materials. The slanted portion 35, is positioned to face the gate. Holes 36 in the top and bottom of the receiving pocket 18 exceed the diameter of the locking pin (not shown) in order to allow the locking pin to traverse these holes when it is released.

Referring to FIG. 4, the detent device 16 is shown in accordance with the first preferred embodiment of the invention. In a preferred embodiment this device will include a section of steel tubing 38 attached to a steel plate 40. A first channel 42 penetrates one side of the detent device 16, beginning opposite the steel plate and traversing approximately half the distance toward the steel plate. A second channel (not shown), exactly opposite the first channel 42, is an exact mirror image of the first channel 42. These channels are narrower in width than the diameter of the spring loaded locking pin.

Figure 5:
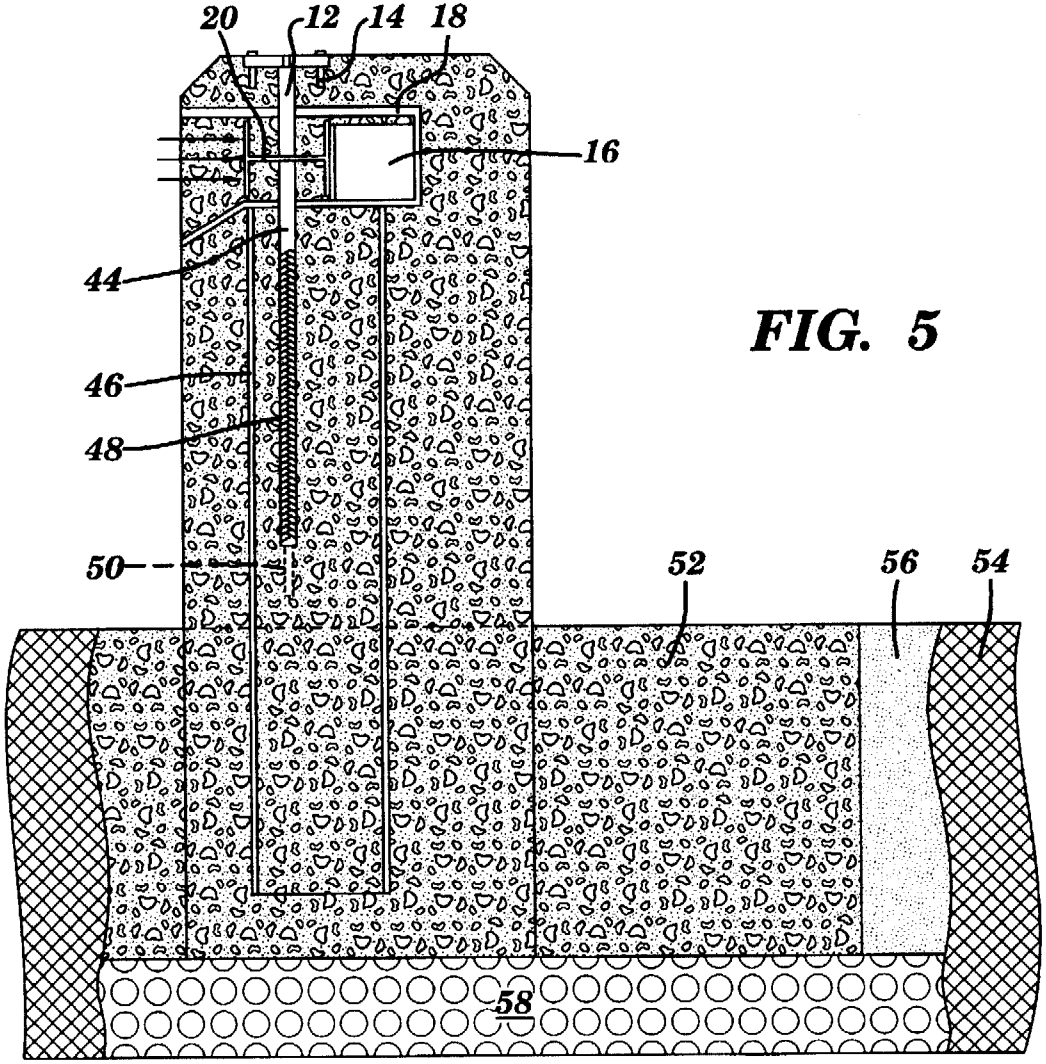
FIG. 5 is a side view of a preferred embodiment of an anchor of the present invention showing the steel pin interconnecting the brace with the anchor.

Referring now to FIG. 5, when the gate is struck by a vehicle, it is forced backward, thus thrusting the brace 20 into the detent device 16. When the brace 20 impacts the detent device 16, the detent device 16 is pushed back further into receiving pocket 18 and the spring loaded locking pin 44 is released.

When it is released, the spring loaded locking pin 44 passes through hole 22 and is stopped by plate 14. Thus, the brace 20, precast concrete anchor 10, and receiving pocket 18 are interconnected by the locking pin 44 into an immovable structure.

If desired, the locking pin 44 may be reloaded by following a series of steps. First, the metallic plate 14, locking pin 44, bracing means 20 and the detent device 16 are removed. Then, the locking pin 44 and the metallic plate 14 are replaced. At this point, a steel rod (not shown) with a diameter small than the hole 12 in the metallic plate 14 is used to force the locking pin downward, thus compressing spring 48. Finally, the detent device 16 is inserted into receiving pocket 18. The channels 42 pointed out in FIG. 4 (showing the detent device 16) allow the detent device to be pushed into place over the locking pin while the steel rod or other loading device holds the locking pin 44 in place. Since these channels are narrower than the diameter of the locking pin they hold the locking pin in a loaded position. The steel rod or other loading device is then removed, leaving the locking pin 44 in a loaded position.

In a preferred embodiment, the precast concrete anchor 10 includes a section of steel tubing 46 underneath the receiving pocket 18 and surrounding the spring 48 and locking pin 44. This embodiment also includes a weep hole 50 for draining rainwater, etc. from around the spring 48 and locking pin 44.

Also in a preferred embodiment, the precast concrete anchor 10 is fortified by a concrete block 52 which is placed behind the precast concrete anchor 10 and underneath the surface of the ground. The precast concrete anchor 10 and the concrete block are set on top of crushed stone 58. Remaining spaces between the undisturbed earth 54 and the precast concrete anchor 10 and concrete block 52 are filled in with backfill 56.

Figure 6:
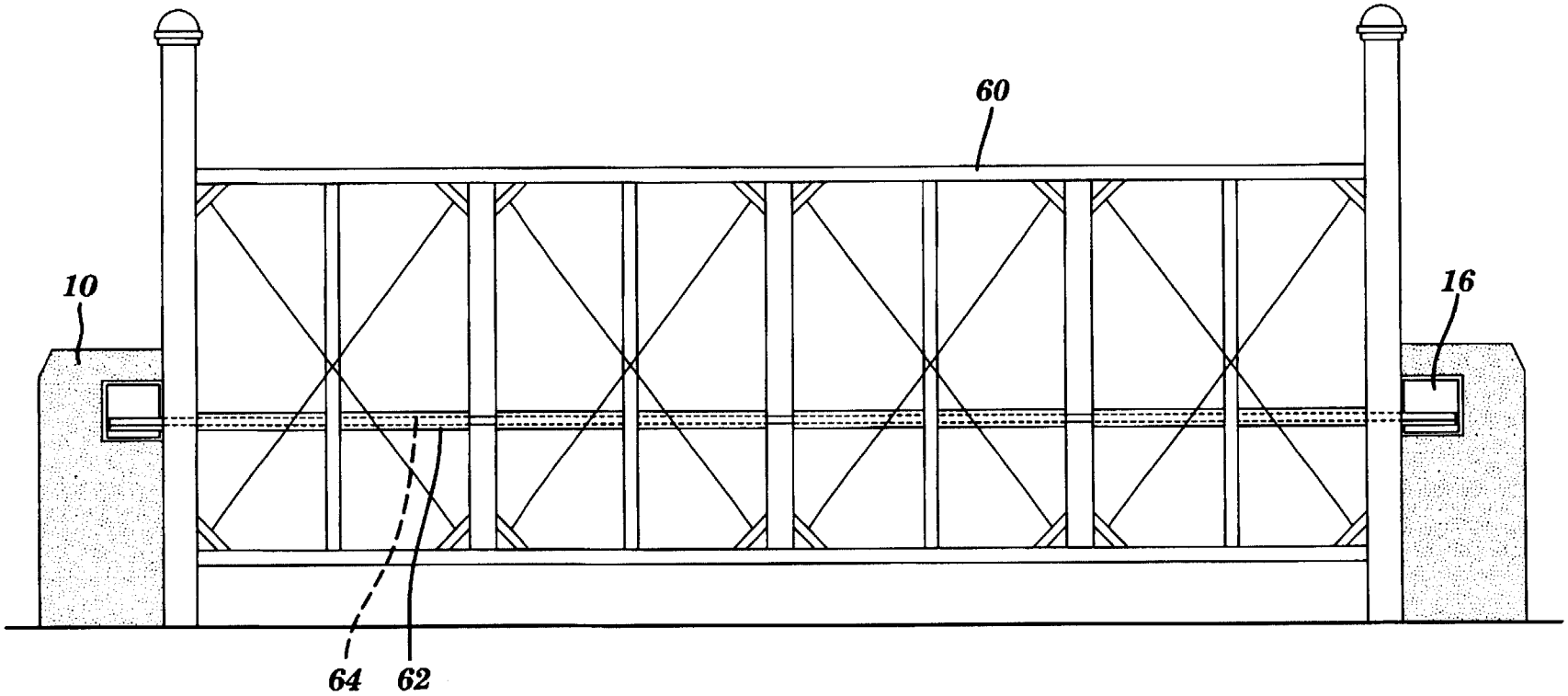
FIG. 6 shows a front view of a preferred embodiment of the present invention.

FIG. 6 depicts the entire gate system and locking mechanism in accordance with a preferred embodiment. The gate 60, may be constructed of chain link, rod iron, or any other materials known within the art. In this embodiment, the precast concrete anchors 10 are positioned behind the gate 60, and set apart at a distance roughly equivalent to the distance between the gateposts 61, 63. In this embodiment, the bracing means is a cable 64 housed in a channel member 62.

Both embodiments of the present invention may have various dimensions and utilize various materials depending upon the projected inertial impact and level of security desired in the gate system. This may be obtained by defining the mass of the object (e.g. vehicle) to be deterred, the velocity at which the object will be traveling at impact, and the allowable displacement distance upon impact. For example, the embodiment of FIG. 2 utilizes a cable which offers greater elasticity. However, greater penetration may be obtained against this embodiment than when using the embodiment of FIG. 1.

The foregoing description of the preferred embodiments of this invention has been presented for purposes of illustration and description. It is not intended to be exhaustive or to limit the invention to the precise form disclosed, and obviously many modifications and variations are possible in light of the above teaching. Such modifications and variations that may be apparent to a person skilled in the art are intended to be included within the scope of this invention as defined by the accompanying claims.

What is claimed is:

1. A system for automatically fortifying a gate comprising:

a gate having a brace; and a plurality of anchors including means, movably positioned within each said anchor, for locking said brace to said anchors when said gate is impacted.

2. The system of claim 1, wherein said brace spans said gate.

3. The system of claim 2, wherein said brace further comprises a structural steel beam.

4. The system of claim 2, wherein said brace further comprises a cable housed in a channel member.

5. The system of claim 1, wherein said plurality of anchors are positioned behind said gate.

6. The system of claim 5, wherein said plurality of anchors further comprises precast concrete structures.

7. The system of claim 1, wherein said means for locking further comprises a spring loaded pin.

8. A fortified gate system comprising:

a gate including a brace, and having engaging devices proximate both ends of said brace; and a plurality of anchors each including a receiving mechanism and a locking mechanism, said brace only being interconnected with said anchors by said locking mechanisms when impacted.

9. The fortified gate system of claim 8, wherein said brace spans said gate.

10. The fortified gate system of claim 9, wherein said brace further comprises a structural steel beam.

11. The fortified gate system of claim 9, wherein said brace further comprises a cable housed in a channel member.

12. The fortified gate system of claim 8, wherein said plurality of anchors further comprises precast concrete structures.

13. The fortified gate system of claim 8, wherein said receiving mechanism further comprises a pocket composed of steel plate.

14. The fortified gate system of claim 8, wherein said locking mechanism further comprises a spring loaded pin.

15. A method for interconnecting a gate having a bracing member with a fortified structure comprising:

providing a gate system having a bracing member, a detent device and a locking mechanism;

impacting said detent device with said bracing member; and lockingly engaging said locking mechanism to said bracing device when said detent device is impacted by said bracing member.

16. The method of claim 15, wherein said detent device is in said fortified structure.

17. The method of claim 16, wherein said locking mechanism interconnects said bracing member with said fortified structure.

18. The method of claim 17, wherein said gate having a bracing member transfers energy upon impact to said fortified structure.

* * * * *